United States Patent [19]

Vinyard

[11] 4,286,366

[45] Sep. 1, 1981

[54] METHOD FOR THE CONSTRUCTION OF A BAFFLED HEAT EXCHANGER

[75] Inventor: Roy E. Vinyard, Bartlesville, Okla.

[73] Assignee: Phillips Petroleum Company, Bartlesville, Okla.

[21] Appl. No.: 127,275

[22] Filed: Mar. 5, 1980

Related U.S. Application Data

[62] Division of Ser. No. 864,122, Dec. 23, 1977.

[51] Int. Cl.[3] ..... B23P 15/26

[52] U.S. Cl. ..... 29/157.4; 165/162; 122/510

[58] Field of Search ..... 165/162, 159–161; 122/510; 29/157.4, 157.3 R, 726, 727, 157.3 D

[56] References Cited

U.S. PATENT DOCUMENTS

| | | | |
|---|---|---|---|
| 2,735,658 | 2/1956 | Cook | 165/160 |
| 3,361,197 | 1/1968 | Mathews | 165/162 |
| 3,720,259 | 3/1973 | Fritz et al. | 165/162 |
| 3,964,146 | 6/1976 | Vestre et al. | 29/157.4 |
| 3,980,440 | 9/1976 | Morse et al. | 23/288 |

FOREIGN PATENT DOCUMENTS

| | | | |
|---|---|---|---|
| 2823 | 11/1979 | European Pat. Off. | 165/162 |
| 1532100 | 11/1978 | United Kingdom | 165/162 |

*Primary Examiner*—Nicholas P. Godici
*Assistant Examiner*—V. K. Rising

[57] ABSTRACT

An improved rod-baffled heat exchanger in which the tube bundle thereof comprises a plurality of tubes supported intermediate their ends by at least one outer support ring and a plurality of baffle rods carried by the outer ring and extending between parallel tube rows. The baffle rods are movable from a first position wherein the tubes adjacent thereto are loosely supported by the rods to facilitate assembly, to a second position wherein the tubes are firmly engaged and radially supported by the rods. Various novel forms of baffle rods are disclosed along with a novel method of construction of the improved heat exchanger.

6 Claims, 14 Drawing Figures

44
48
24
40
44
52
48
20
50
50
20
52
52
50
46
42
52'
50
52'
50
20
20
44
52
52
50
50
50
50
46
42
52
50
52'
50
52'
50
52'
50
48
72
52
52
52
50
50
50
50
50
46
42
52
52'
50
52'
50
52'
50
48
52
52
52
44
44
48
44
44
20
20
20
20
50
50
20
50
46
42
42
52
50
52
52
52
20
20
20
50
44
44
48
50
52
52
50
50
50
50
50
52
42
42
52
52
52
52
52
52
46
72
50
50
52
52
52
52
50
50
50
50
50
46
52
50
50
42
42
52
52
52
52
52
48
50
50
50

METHOD FOR THE CONSTRUCTION OF A BAFFLED HEAT EXCHANGER

This application is a divisional of copending application Ser. No. 864,122, filed Dec. 23, 1977.

The present invention relates generally to heat exchangers and to methods of heat exchanger construction.

Heat transfer is an important part of any process. As is well known, an indirect transfer of heat from one medium to another is usually accomplished by the use of heat exchangers of which there are many types. For example, there are double pipe, shell and tube, plate heat exchangers and others. Indeed the art of heat exchanger design is developed to a very high degree. However, there is still room for improvement in a number of areas, such as reducing pressure drop, increasing overall heat transfer coefficients, reducing fouling, and in heat exchangers utilizing a tube bundle, such as the shell and tube heat exchangers, improving the tube support and ease of assembly. In many instances, the tubes in a shell and tube heat exchanger prematurely fail because the tubes vibrate or rub against one another or other parts of the heat exchanger, such as for example, a baffle or the shell.

The art has heretofore recognized the need for tube support. Plate type baffles have been used in heat exchangers for many years. Such baffles provide support for the tubes at least to some degree. The double segmental plate-baffle heat exchanger is well known to those skilled in the art, and although heat exchangers using plate-type baffles were a relatively early development in heat exchanger design, such exchangers are still widely used today. In most plate-type baffle heat exchangers the passages in the plate baffles through which the tubes pass are slightly larger in diameter than the outside diameter of the tubes in order to facilitate construction of the exchanger, and, as a result, vibration of the tubes can and does often occur, which frequently results in premature tube failure.

It is desirable to be able to assemble a heat exchanger without having zero clearance between tube-supporting baffle rods or bars and the tubes while the tubes are being installed between the rods and into the tube sheet. Due to manufacturing variances, the rod and tubes are sometimes slightly larger or smaller than specified. Due to such dimensional variations, by the time several rows of tubes have been installed through the baffle rods, the tubes do not match the corresponding apertures in the tube sheet and are so tight in the rod baffle structures that damage can be done to the tubes during the assembly procedure.

If, however, the outer diameters of either or both the tubes and the rods are designed with slightly smaller dimensions to facilitate the complete assembly of the tube bundle, then the tubes will not be tight in the baffles and will be subject to vibration-induced wear during operation which can result in tube damage and premature failure of the heat exchanger.

In accordance with the present invention I have discovered that an improved heat exchanger structure is provided by utilizing at least one baffle support in the tube bundle intermediate the opposite ends of the tubes which permits loose passage of the tubes therethrough during assembly of the tube bundle and subsequently permits firm engagement of these tubes when the tubes are properly positioned.

More specifically, one aspect of the present invention provides method for assembly the tube bundle of a heat exchanger wherein at least one outer ring, carrying a first plurality of substantially parallel rods and a second plurality of substantially parallel rods inclined at an angle to the first plurality of rods, receives a plurality of tubes loosely therethrough in a first position of the rods and, in a second position of the rods, provides firm engagement of the tubes by the rods thereby providing simplified tube bundle construction and firm engagement of the tube intermediate their opposite ends.

In another aspect of the present invention, novel apparatus is provided for the tube bundle of a heat exchanger comprising a plurality of tubes with at least one outer ring encircling the tubes intermediate their ends. At least one of the outer rings carries a plurality of rods each having opposite ends and positioned in a space between adjacent tube rows, each rod having at least one first region of reduced thickness on the surface thereof for allowing movement of adjacent tubes therepast in a first position thereof and having at least one second region of increased thickness on the surface thereof adjacent the first region for firmly engaging adjacent tubes in a second position of the rod to prevent movement of the tubes. Means are also provided for securing each of the rods to the outer ring in its second position.

An object of the present invention is to provide improved support for tubes of a tube bundle.

Another object of the present invention is to provide an improved method of assembly of the support rods in a tube bundle of a heat exchanger.

Yet another object of the present invention is to provide improved reliability in a shell and tube heat exchanger.

Still another object of the present invention is to facilitate the construction of heat exchangers.

Other objects, aspects and advantages of the present invention will be apparent to those skilled in the art upon reference to the present specification and accompanying drawings in which.

Figure 1:
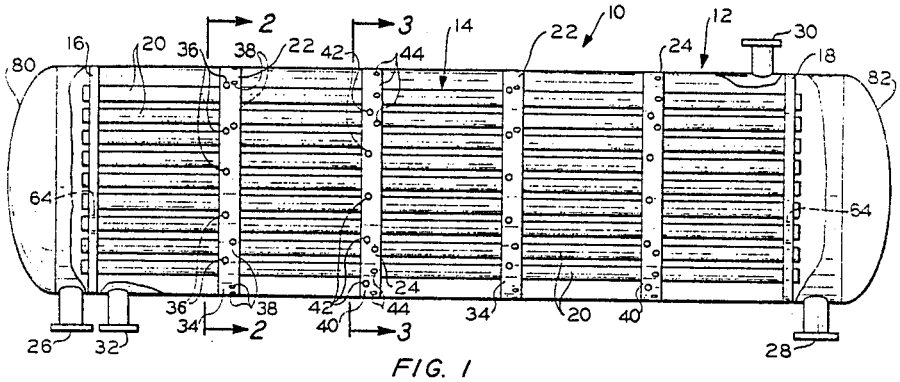
FIG. 1 is a side elevation view of a heat exchanger employing a tube bundle constructed in accordance with the present invention with portions of the shell broken away to more clearly illustrate the internal construction thereof.

Referring now to the drawings, and to FIG. 1 in particular, a single pass shell and tube heat exchanger, generally designated by the reference character 10, is illustrated therein. The heat exchanger 10 comprises a shell 12 and a tube bundle 14 positioned therein.

The tube bundle 14 includes a pair of tube sheets 16 and 18 having apertures formed therein through which the opposite ends of a plurality of tubes 20 extend. The opposite ends of the tubes are secured to the respective tube sheets to provide support for the plurality of parallel aligned tubes 20. A pair of baffles 22 and a second pair of baffles 24 are positioned alternately along the longitudinal axes of the parallel tubes 20 in spaced relation and provide support for the tubes intermediate the tube sheets 16 and 18. While the baffles 22 and 24 are shown lying in a plane normal to the longitudinal axis of the tubes 20 of the tube bundle 14, it is possible to use baffles which are not in planes perpendicular or normal to the longitudinal axis of the tube bundle, however, baffles lying in perpendicular or normal planes as shown are more easily and economically constructed and are thus preferred.

Nozzles 26 and 28 communicate with the respective opposite ends of the tube side of the heat exchanger 10 providing means for passing a first fluid through the tubes. Nozzles 30 and 32 communicate with the respective ends of the shell side of the heat exchanger 10 and provide means for passing a second fluid over the outside surfaces of the tubes when preferably using countercurrent flow of the heat exchange fluids or mediums.

Figure 2:
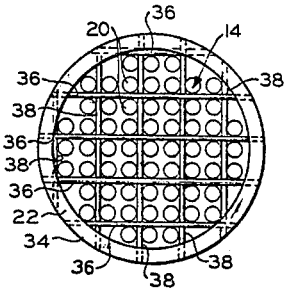
FIG. 2 is a cross-sectional view taken along line 2—2 of FIG. 1.
Figure 3:
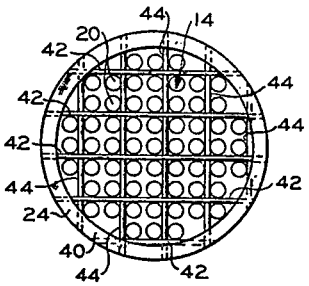
FIG. 3 is a cross-sectional view taken along line 3—3 of FIG. 1.
Figure 11:
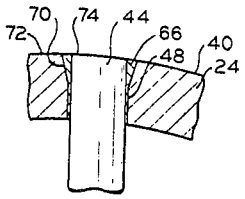
FIG. 11 is an enlarged cross-sectional detail view illustrating one form of securement between a baffle rod and an outer ring.
Figure 13:
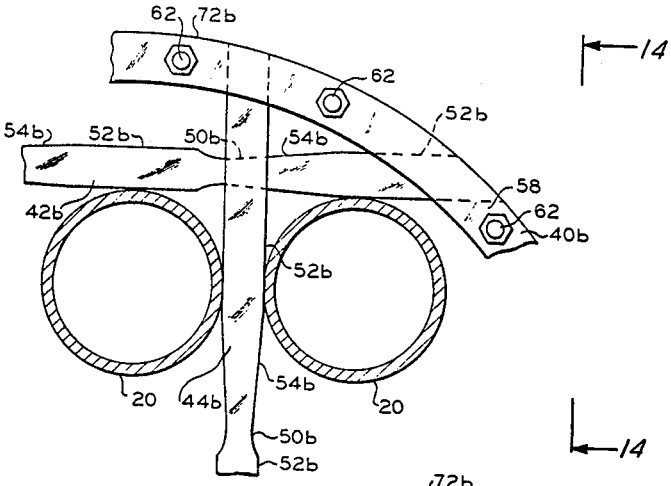
FIG.13 is an enlarged cross-sectional detail view illustrating a form of bolted securement between baffle rods and an outer ring.
Figure 14:
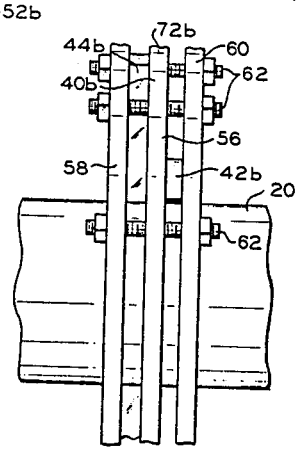
FIG. 14 is an enlarged detail view taken along line 14—14 of FIG. 13.

The tubes 20 in the heat exchanger 10 are laid out in a square pitch, and generally a square pitch tube layout provides greater surface area for a given shell diameter for an apparatus constructed in accordance with the present invention. This layout of the tubes 20 is best illustrated in FIGS. 2 and 3. It will be seen that the tubes 20 thus laid out form a plurality of vertically spaced horizontal tube rows and a plurality of horizontally spaced vertical tube rows. The baffles 22 illustrated in FIG. 2 comprise a baffle or supporting ring 34 encircling the tubes 20. A plurality of horizontally extending baffle rods or bars 36 are fixedly secured at their opposite ends in the supporting ring 34 and extend between alternate pairs of horizontal parallel tube rows. A plurality of vertically extending baffle rods or bars 38 are fixedly secured at their opposite ends in the supporting outer ring 34 and extend between alternate pairs of vertical parallel tube rows. The opposite ends of the rods 36 and 38 may be suitably secured to the outer ring 34 by welding as shown in either FIG. 11 or FIG. 12 or may be bolted thereto as illustrated in FIGS. 13 and 14.

The construction of the baffle 24 is illustrated in FIG. 3. The baffle 24 comprises an outer supporting baffle ring 40 which encircles the tubes 20 in a manner similar to that described for the ring 34. A plurality of horizontally extending baffle rods or bars 42 are movably secured at their opposite ends in the outer ring 40 and extend between alternate pairs of horizontal parallel tube rows. It will be noted, however, that the tube rows between which the rods 42 extend are not the tube rows between which the rods 36 of the baffle 22 extend. The rods 42 are positioned between horizontal tube rows which are open or unbaffled in the baffle 22. Similarly, the baffle 24 includes a plurality of vertically extending baffle rods or bars 44 movably secured at their opposite ends in the supporting outer ring 40 which rods extend between alternate pairs of vertical parallel tube rows. The rods 44 are not positioned between the same vertical tube rows through which the baffle rods 38 of the baffle 22 extend, but rather extend between adjacent vertical tube rows which are open in the baffle 22.

Figures 4, 5:
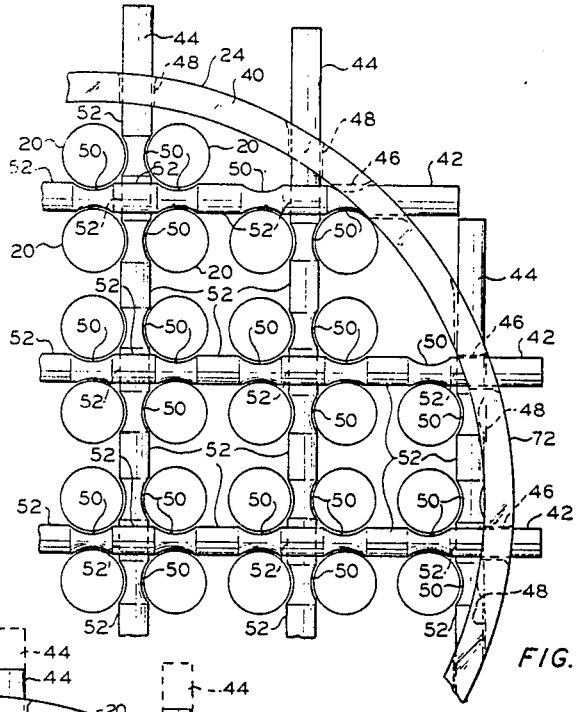
FIG. 4 is an enlarged partial view of the tube bundle structure of FIG. 3 and illustrates the relative positions of the outer ring, baffle rods and tubes with the tubes loosely disposed between the rods.
FIG.5 is an enlarged partial view of the tube bundle structure, similar to FIG. 4, and illustrates the relative positions of the outer ring, baffle rods and tubes with the baffle rods moved to their second positions securely engaging the tubes, with the initial positions of the baffle rods and tubes indicated by dashed lines.

The rods 36 and 38 of the baffles 22 are of such thickness or diameter as to be closely received between the tubes of the adjacent horizontal and vertical tube rows, respectively. As best shown in FIGS. 4 and 5, the opposite ends of the rods 42 and 44 are slidably received within corresponding apertures 46 and 48 extending through the outer ring 40. Each of the rods 42 and 44 includes a plurality of first region of reduced thickness 50 spaced along the length of the respective rod in correspondence to the center to center distance between the tubes 20 of adjacent tube rows. The regions of reduced thickness 50 may be circular in cross-section as illustrated in FIGS. 4 and 5 and as further illustrated in FIG. 10, or otherwise shaped. Each region of reduced thickness 50 is preferably approximately 1/16-inch (1.5875 mm) less in thickness than the space between adjacent tubes in the tube row separated by the baffle rod. The baffle rods 42 and 44 further include second regions of increased thickness 52 disposed adjacent the first regions of reduced thickness 50. These regions of increased thickness 52 may be of either circular or rectangular cross-section. The thickness of the second regions of increased thickness 52 are preferably slightly greater than the normal distance between adjacent tubes of the tube rows separated by the respective baffle rods.

Figure 10:
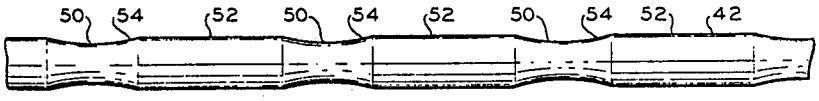
FIG. 10 is a partial side elevation view of another form of baffle rod constructed in accordance with the present invention and having a substantially circular cross-section.

FIG. 10 illustrates an enlarged portion of a baffle rod or bar 42 illustrating the region of reduced thickness 50 and the region of increased thickness 52 thereon. The rod illustrated in FIG. 10 is preferably circular in cross-section throughout its entire length. The first region of reduced thickness 50 is arcuately shaped along the longitudinal axis of the rod, and conforms generally to the configuration of the outer surface of the tubes 20. It will be noted that the arcuate shape of the region of reduced thickness 50 provides a third transitional region 54 formed on the surface of the rod extending between the first and second regions 50 and 52 and increasing in circular cross-sectional area between the first and second regions.

Figure 9:
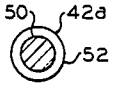
FIG. 9 is a cross-sectional view taken along line 9—9 of FIG. 8.
Figure 8:
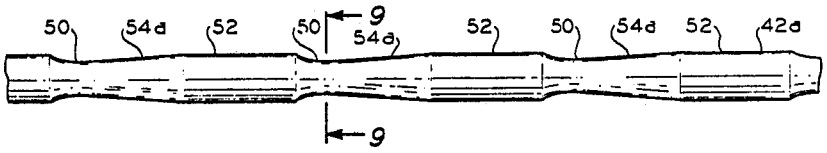
FIG. 8 is a partial side elevation view of another form of baffle rod constructed in accordance with the present invention and having a substantially circular cross-section.

FIGS. 8 and 9 illustrate a slightly modified version of the rod or bar of FIG. 10 which will be designated by the reference character 42*a*. In the rod 42*a*, the first regions of reduced thickness 50 and the second regions of increased thickness 52 are of circular cross-section as in the rod 42. The third transitional region 54*a* interconnecting each of the first and second regions 50 and 52 provides a frusto-conically shaped surface on the rod 42*a* increasing in circular cross-section from each first region 50 to each corresponding second region 52. This configuration of the third transitional region 54*a* provides a more gradual transition between each region of reduced thickness and the corresponding region of increased thickness.

Figure 6:
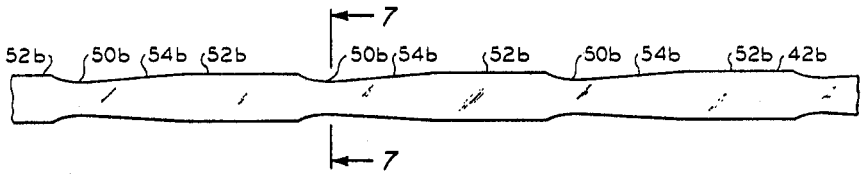
FIG. 6 is a partial side elevation view of one form of baffle rod constructed in accordance with the present invention and having a substantially rectangular cross-section.
Figure 7:
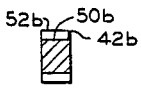
FIG. 7 is a cross-sectional view taken along line 7—7 of FIG. 6.

FIGS. 6 and 7 illustrate a third form of baffle rod or bar of substantially rectangular cross-section which is designated by the reference character 42*b*. The first regions of reduced thickness of the rod 42*b* are designated by the reference character 50*b*, and the second regions of increased thickness are designated by the reference character 52*b*. Each region of reduced thickness 50*b* is connected to a corresponding region of increased thickness 52*b* by a third transitional region 54*b* formed on the surface of the rod of increasing rectangular cross-sectional area from the region of reduced thickness to the region of increased thickness.

FIGS. 13 and 14 illustrate the connections of the baffle rod or bar 42*b* and a similarly constructed vertical baffle rod or bar 44*b* to a modified outer supporting ring designated by the reference character 40*b*. The outer ring 40*b* comprises a central ring member 56 and a pair of external ring members 58 and 60 which cooperate with threaded bolts 62 to fixedly secure the outer ends of the rods 42*b* and 44*b* to the outer ring 40*b*.

It should be noted at this point that the rods 36, 38, 42 and 44 can be constructed of round or square tubing material and the regions of reduced thickness 50 between the regions of increased thickness 52 can be advantageously and economically formed by stamping whereby the regions of reduced thickness are substantially flat at their midpoints between adjacent regions of increased thickness. Such flat regions of reduced thickness are preferably oriented with the major axis thereof in alignment with the longitudinal axes of the tubes to thereby present a minimum cross-sectional area to the flow of fluid around the baffle rods and reduce the pressure drop of the flowing fluid across the rods.

To assemble the heat exchanger 10, the tubes 20 are inserted through the baffles 22 and 24 which are spaced apart as illustrated in FIG. 1. At this point the rods 42 and 44 of the baffles 24 are movably supported by the respective supporting rings 40 in the position illustrated in FIG. 4 thereby permitting the free passage of the tubes 20 through the baffles 22 and 24. The ends of the tubes 20 are then received through the corresponding apertures 64 formed in the tube sheets 16 and 18. When suitably positioned, the tubes 20 are fixedly secured to the tube sheets 16 and 18 with the end of each tube forming a fluid tight seal with the corresponding aperture in the tube sheet.

The rods 42 and 44 of the baffles 24 are then driven or otherwise moved from their first positions as illustrated in FIG. 4 to their second positions as illustrated in FIG. 5, the dashed lines in FIG. 5 illustrating the previous positions for the rods 42 and 44.

When the rods 42 and 44 of the baffles 24 are positioned as illustrated in FIG. 5, the tubes of the adjacent tube rows are firmly engaged by the second regions of increased thickness 52 on the rods 42 and 44. The rods are then fixedly secured to the outer ring 40 by suitable means such as by welding, as shown at 66 in FIG. 11, between the rod 44 and the corresponding aperture 48 formed in the ring 40 in which the rod is received. A similar weld connection is made between the end of each rod 42 and the corresponding aperture 46 in the ring 40. Each aperture 46 and 48 preferably includes a beveled portion 70 communicating with the outer periphery of the supporting ring 40 in which a weld fillet 66 can be formed. The outer end of each rod is then cut off and contoured to conform to the outer periphery 72 of the outer ring 40 by suitable means such as grinding as shown at 74.

Figure 12:
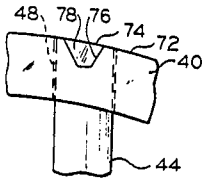
FIG. 12 is an enlarged elevation detail view illustrating another form of securement between a baffle rod and an outer ring.

FIG. 12 illustrates a modified connectin between a baffle rod 44 and the outer ring 40 in which a transverse groove 76 is formed in the outer periphery 72 of the ring 40 intersecting each aperture 46 and 48 in which a suitable weld fillet 78 can be formed to fixedly secure the rod to the outer ring. The outer end of the rod 74 is again cut off and contoured to match the outer periphery 72 of the outer ring 40 by suitable means such as grinding.

In the event the alternate baffle structure illustrated in FIGS. 13 and 14 is employed, when the rods 42*b* and 44*b* are driven or otherwise moved to their second positions firmly engaging the tubes 20 with the second regions of increased thickness 52*b* thereof, the rods are then securely engaged to the outer ring 40*b* by tightening the threaded bolts 62 to secure the rods between the ring members 56, 58 and 60. The outer ends of the rods are then cut off and contoured to conform to the outer periphery 72*b* of the outer ring 40*b* by suitable means such as grinding as described above.

Once the baffle rods of the baffles 24 are fixedly secured in their second positions firmly engaging the tubes 20 with their outer ends contoured to conform to the outer periphery of the outer supporting rings, the tube bundle 14 thus assembled is inserted into the open end of the shell 12 and properly positioned therein at which time the open ends of the shell 12 are closed by suitable end caps 80 and 82.

It will be seen that the method and apparatus described above provides advantages in the construction of shell and tube heat exchangers, notably in the increased ease of assembly of this structure and in the reliable firm engagement of the tubes thereof intermediate their opposite ends. The transitional regions between the regions of reduced thickness and increased thickness facilitate the movement of the movable baffle rods from their first positions loosely engaging the tubes previously extended therepast to their second positions firmly engaging the tubes adjacent thereto.

While four baffles, two having fixed baffle rods and two having movable baffle rods, have been described above, it will be readily apparent to those skilled in the art that various numbers of both fixed rod and movable rod baffles may be employed in the construction of a heat exchanger in accordance with the present invention depending upon various design constraints. Similarly, while a square pitch tube layout is described above, other tube layouts may be employed in a heat exchanger constructed in accordance with the present invention. It will be noted, however, that the square pitch tube layout disclosed herein when employed with the baffle structures also disclosed herein provides full radial support for the intermediate portions of the tubes of the heat exchanger. Further, while outer supporting rings of circular shape are herein disclosed, it will be understood that the present invention envisions annular baffle and tube supporting structues of other than circular shape depending on specific heat exchange design considerations.

Resonable variations and modifications which will be apparent to those skilled in the art can be made in this invention without departing from the spirit and scope thereof.

I claim:

1. A method of assembly of heat exchange tube bundle comprising a plurality of tubes, at least one outer ring, a plurality of rods supportable by each outer ring, each of said rods having at least one first region of reduced thickness providing means for allowing movement of a tube adjacent said first region in a first position of each of said rods to facilitate assembly of said tube bundle and each of said rods having at least one second region of increased thickness adjacent to a corresponding first region of reduced thickness and providing means for firmly engaging and preventing movement of a tube adjacent said second region in a second position of each of said rods. and at least one tube sheet, comprising the steps of:

a. supporting a first plurality of said rods in a first position across each outer ring in spaced mutually parallel relation;

b. supporting a second plurality of said rods in a first position across each outer ring in spaced mutually parallel relation, the common axis of alignment of said second plurality of rods being substantially normal to the common axis of alignment of said first plurality of rods;

c. inserting a plurality of said tubes through each of said outer rings in spaced mutually parallel relation, the common axis of alignment of said tubes being substantially normal to the common axis of alignment of said first plurality of rods and to the common axis of alignment of said second plurality of rods, each tube being positioned proximate one of said first plurality of rods and one of said second plurality of rods in each outer ring;

d. securing the outer ends of said tubes to a tube sheet; and e. moving the first and second pluralities of rods in at least one of said outer rings from the respective first positions thereof to respective second positions thereof and thereby firmly engaging the respective tubes proximate thereto.

2. The method as defined in claim 1 characterized further to include the additional step of:

f. fixedly securing said first and second pluralities of rods to the respective supporting outer rings in the respective second positions of said rods.

3. The method as defined in claim 1 characterized further to include the additional step of:

f. welding said first and second pluralities of rods to the respective supporting outer rings in the respective second positions of said rods.

4. The method as defined in claim 3 characterized further to include the additional step of:

g. removing any excess of rod material and weld material from said supporting outer rings.

5. A method of constructing a heat exchange tube bundle assembly comprising a plurality of tubes having opposite ends, a plurality of outer rings for encircling said tubes, a plurality of rods supportable by each outer ring, each of said rods having at least one first region of reduced thickness providing means for allowing movement of a tube adacent said first region in a first position of each of said rods to facilate construction of said tube bundle assembly and each of said rods having at least one second region of increased thickness adjacent to a corresponding first region of reduced thickness and providing means for firmly engaging and preventing movement of a tube adjacent said second region in a second position of each of said rods for radially supporting said tubes, and a pair of apertured tube sheets for connection with the respective opposite ends of said tubes, comprising the steps of:

a. fixedly securing a first plurality of said rods in positions extending horizontally across at least one first one of said outer rings in vertically spaced mutually parallel relation;

b. fixedly securing a second plurality of said rods in positions extending vertically across each said first one of said outer rings in horizontally mutually parallel relation;

c. positioning a first plurality of said rods in respective first positions extending horizontally across at least one second one of said outer rings in vertically spaced mutually parallel relation;

d. positioning a second plurality of said rods in respective first positions extending vertically across each said second one of said outer rings in horizontally spaced mutually parallel relation;

e. inserting a plurality of horizontally aligned tubes through said first and second outer rings in vertically and horizontally spaced mutually parallel relation, each of said tubes being loosely positioned proximate one of said first plurality of rods and one of said second plurality of rods in each of said first and second outer rings;

f. fixedly securing the opposite ends of each of said tubes in respective apertures of said apertured tube sheets;

g. moving the first and second plurality of rods in said at least one second one of said outer rings from the respective first positions thereof to respective second positions to firmly engage the respective tubes proximate thereto whereby each of said plurality of tubes is additionally brought into firm engagement with one of the first plurality of rods and one of the second plurality of rods of said at least one of said outer rings to provide radial support for each of said tubes intermediate said tube sheets; and h. fixedly securing said first and second plurality of rods of said at least one second one of said outer rings to said at least one second one of said outer rings in their respective second position to form said heat exchange tube bundle assembly.

6. The method as defined in claim 5 wherein two first outer rings are constructed in accordance with steps a and b and two second outer rings are constructed in accordance with steps c and d, and said first and second outer rings are positioned alternately in longitudinally spaced relation relative to said plurality of tubes.

* * * * *